United States Patent [19]

Kurylko

[11] Patent Number: 4,497,376

Date of Patent: Feb. 5, 1985

[54] INTERCHANGEABLE RAM DIESEL PILE

[75] Inventor: George Kurylko, Hanover, N.J.

[73] Assignee: MKT Geotechnical Systems, Dover, N.J.

[21] Appl. No.: 404,367

[22] Filed: Aug. 2, 1982

[51] Int. Cl.[3] ..... F21B 7/00; F01B 29/04

[52] U.S. Cl. ..... 173/1; 173/29; 173/134; 173/138; 91/54; 91/47

[58] Field of Search ..... 173/1, 29, 115, 125, 173/128, 132, 134, 138, 139; 91/54, 47-51, 250, 91/253, 261, 270; 92/59

[56] References Cited

U.S. PATENT DOCUMENTS

| | | | |
|---|---|---|---|
| 767,527 | 8/1904 | Paulson | 92/59 |
| 2,740,385 | 4/1956 | Haage | 173/135 X |
| 3,161,184 | 12/1964 | Koftan | 173/135 X |
| 3,193,206 | 7/1965 | Kupka | 173/135 |
| 3,760,887 | 9/1973 | Palauro | 173/29 |
| 3,789,930 | 2/1974 | Nishimura et al. | 173/1 |
| 3,934,423 | 1/1976 | Haller | 92/59 |
| 4,109,621 | 8/1978 | Hashimoto et al. | 173/135 X |

FOREIGN PATENT DOCUMENTS

| | | | |
|---|---|---|---|
| 632801 | 11/1978 | U.S.S.R. | 173/135 |

*Primary Examiner*—E. R. Kazenske
*Assistant Examiner*—Willmon Fridie
*Attorney, Agent, or Firm*—Kramer and Brufsky

[57] ABSTRACT

A diesel-engine pile driving hammer provided with interchangeable rams for use in a single, outer, cylindrical casing. A large diameter hole or orifice is provided in the casing between a pair of an array of alternate orifices which are capable of being plugged. The larger orifice or alternate orifices provide an air inlet-exhaust port or ports of sufficient dimension to enable all of the exhaust gases of combustion to be expelled in the time it takes a ram of designated weight to travel its upward stroke in the casing and to vary the swept volume of air introduced into the combustion chamber in the casing so that different weight, interchangeable rams may be accomodated in the same outer cylindrical casing to obtain prescribed impact energy values.

3 Claims, 7 Drawing Figures

INTERCHANGEABLE RAM DIESEL PILE

BACKGROUND OF THE INVENTION

1. Field Of The Invention

This invention relates to a diesel pile driving hammer, and more particularly, a diesel pile driving hammer provided with interchangeable rams.

2. Description of the Prior Art

Diesel pile driving hammers are drop hammers. A ram within an outer cylindrical casing is used to contact an anvil connected to a drive cap seated on the pile. The initial power to lift the ram is furnished by a hoist line carrying the ram upward on a trip block. At the top of the start stroke, the ram is released from the hoist line to fall through the outer hammer cylinder casing and to successively close the cylinder casing intake-air exhaust openings, compress and heat entrapped air which has been captured within the cylinder casing between the ram and anvil and explode atomized diesel fuel which has been injected and mixed with the entrapped and compressed air. The explosion of the fuel mixture of entrapped air and injected diesel fuel sends the ram back up the cylinder casing, exhausting the spent gases, and commencing a repeat of the cycle. The hammer is stopped by interrupting the fuel flow into the cylinder casing. During the dropping of the ram, the ram will contact the anvil to drive the pile and drive cap as it compresses the fuel mixture, just prior to the explosion which drives the ram back up to the top of its stroke wherein the cycle is repeated.

Standard diesel hammers have ram weights varying from one thousand to twenty thousand pounds. The theoretical available impact energy delivered per blow by a diesel hammer is a function of the the amount of fuel introduced into the hammer, the ram weight, and the efficiency of combustion within the cylinder. Traditional means of designing impact atomization diesel pile hammers to provide different delivered impact energy values has been to vary the ram weight and the fuel volume introduced into the hammer cylinder. The flight of the ram is the indicator of the efficiency of the explosive force at impact, since about all of the net energy from the exploding fuel is utilized in propelling the ram upward. The net energy of the explosion is thus reflected by the ram stroke times the ram weight. Accordingly, to obtain maximum impact it is necessary to maintain the proportional geometry of the combustion chamber, e.g., to obtain the optimum efficient fuel mixture volume, so that the maximum upward flight of the ram is obtained upon the utilization of different ram weights. This has been accomplished in the past by providing different cylinder shell or casing sizes with rams of different weights.

Relatively recently, the user of pile drive hammers, the foundation contractor, has been charged with not only providing a specific delivered energy from a hammer used to install pile foundations, but also to provide a hammer with its ram weight restricted within a range for a specific energy output and pile to be driven. Accordingly, it has become more economical to design a pile driving hammer having a single cylindrical casing with interchangeable rams of different weights within the specified range and to maximize the geometry of the combustion chamber in the outer cylindrical casing so as to arrive at the required specific, delivered energy from the hammer per blow. Such a hammer also provides for considerable investment economy for the user in that all that is necessary are interchangeable, different weight rams interfacing with the same cylinder and anvil block. The rams used may be of different weight and the final compressed air volume and thus fuel mixture may be varied by reducing the height of the annulus formed between the bottom edge of the ram piston and the top edge of the anvil block at contact, by changing the ram and/or piston geometry. Additional control of the fuel mixture may also be accomplished at the fuel pump introducing atomized fuel into the combustion chamber and by reducing the swept volume of air compressed in the combustion chamber at ram-anvil contact, by providing auxiliary, alternate, air inlet-exhaust ports at a location lower than the normal air inlet-exhaust ports in the outer cylinder casing wall. These auxiliary ports can be closed with high strength pipe plugs when not needed, for example, when a ram of a lighter weight is used.

As indicated, one of the design problems in achieving the required impact energy per blow for a different ram of heavier weight in the same cylindrical casing has been to maintain the proper proportional geometry of the combustion chamber for a particular ram weight and thus fuel mixture so as to achieve the required flight of the ram during each stroke of its cycle. One attempted solution as noted above, was to provide auxiliary air inlet-exhaust ports to reduce the swept volume of air compressed in the combustion chamber. But, since the inlet ports of an impact diesel pile hammer are also the exhaust ports, the ports must also provide a sufficient nonrestricted opening to expel all of the exhaust gases of combustion in the time it takes the ram to travel its upward stroke, which may be on the order of less than 0.35 seconds, while also providing a reduction in the swept volume of air introduced into the combustion chamber.

SUMMARY OF THE INVENTION

Accordingly, the present invention provides such a solution in an interchangeable ram diesel pile hammer. Such a solution entails the utilization of a single large diameter hole or orifice as an alternate air inlet-exhaust port in the outer cylindrical ram casing located above and between a pair of the normal array of inlet-exhaust ports. The alternate, larger port can be utilized with a heavier and geometrically sized ram. All the ports except the large diameter hole are plugged and closed when operating the hammer with the heavier ram. Conversely, the heavier ram inlet-exhaust port can be left open when using the lighter ram as there will be no change in swept air volume with the lighter ram and all of the exhaust gases of combustion can be expelled in as an expedient manner.

BRIEF DESCRIPTION OF THE DRAWINGS

Further objects and advantages of the present invention will become more apparent from the following description and claims, and from the accompanying drawings, wherein:

DETAILED DESCRIPTION OF THE PREFERRED EMBODIMENT

Figures 1A, 1B, 1C, 1D, 1E:
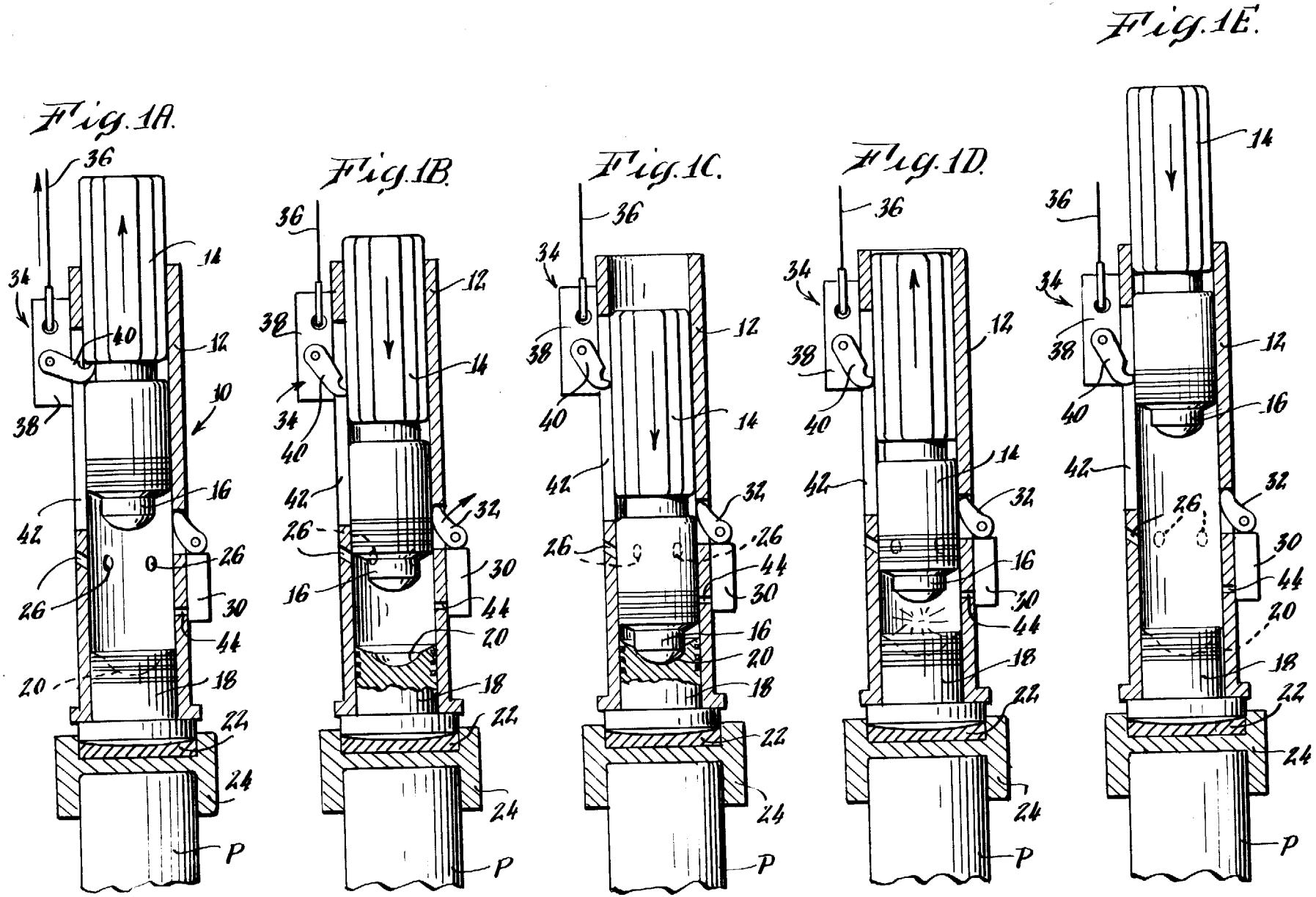
FIGS. 1A–1E, inclusive are schematic diagrams illustrating the operation of a conventional diesel pile driving hammer.

FIGS. 1A–1E illustrate the operation of a conventional single-acting diesel pile driving hammer generally designated by the numeral 10.

The hammer consists of an outer casing or cylinder 12 slidably receiving a ram 14 having a head or piston 16 adapted to impact an anvil 18 provided with a semi-spherical bore 20 shaped substantially complementary to the head of piston 16 of ram 14. Anvil 18 is seated on cushioning material 22 provided in a pile cap 24 seated on the top of a pile P which is to be driven into a foundation. Cylinder 12 is also provided with one or more air intake-exhaust ports 26 extending therethrough. A fuel pump 30 operated by a trip cam 32 is also mounted on the wall of cylinder 12. A hoist mechanism 34 including a load line 36 is connected to a trip block 38 pivotably mounting a lever 40 extending through an elongated slot 42 in the wall of cylinder 12 and seated beneath the head of ram 14. The trip block 38 is slidable along the wall of outer cylinder 12.

FIGS. 1A, 1B, 1C, 1D and 1E illustrate the tripping, fuel injection, compression-impact, explosion, and top of stroke cycles, respectively, of the operation of an open-end, single-acting, diesel, impact pile driving hammer. The hammer is initially operated by load line 36. A crane (not shown) raises the load line 36 and trip mechanism block 34 so that the trip lever 40 is pivoted in slot 42 upon contact with the upper end of the slot formed in the wall of outer cylinder 12 to release the ram 14 and piston 16 as shown in FIG. 1B. The ram 14 and piston 16 falls downwardly through the outer cylinder 12, contacting fuel cam 32, which pivots in the direction of the arrow, or in a clockwise direction, as viewed in FIG. 1B. Pivoting of fuel cam 32 actuates fuel pump 30 to spray a metered amount of atomized fuel through opening 44 into the cylinder between piston 16 and anvil 18. The fuel settles in semi-spherical cup 20 in anvil 18. The amount of fuel sprayed from fuel pump 30 can be controlled by a suitable manual control on the pump.

As the ram 14 and piston 16 continues to fall, the ram-piston blocks the exhaust ports 26, compressing the air trapped between the piston 16 and the anvil 18 in cup 20, as indicated in FIG. 1C. This compressed air creates a preloading force on the anvil 18, drive cap 24, and pile P. Next, the ram 14 and piston 16 strikes the anvil 18 by entering the semi-spherical cup 20 and transmits the impact energy to the pile cap 24, while splashing fuel into the annular zone around the piston 16 and anvil 18 where it ignites on contact with the hot, high-pressure air compressed by the ram-piston.

The resultant explosive force drives the ram-piston upward and the pile P further downward as indicated in FIG. 1D. On the up-stroke, the ram-piston opens the exhaust ports 26 to discharge the hot exhaust gases of combustion. The ram-piston continues freely upwardly until stopped by gravity.

Having reached the top of its stroke, the ram 14 and piston 16 drops again, repeating the cycles illustrated in FIGS. 1B–1C, inclusive. The operation of the pile driving hammer 10 is stopped by manually pulling and disengaging the fuel pump cam 32 to preclude further fuel from being introduced into the cylinder beneath the piston 16.

Figure 2:
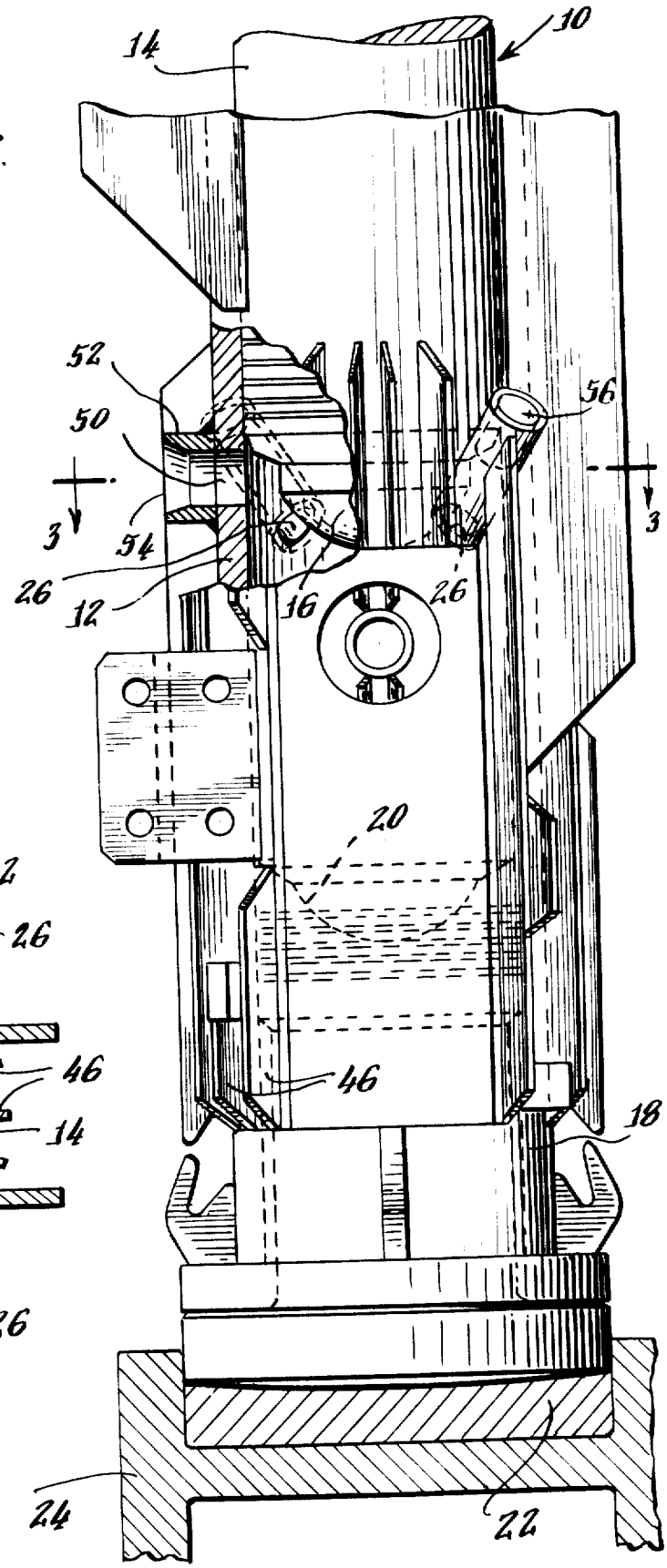
FIG. 2 is a side view in elevation, with portions illustrated in section, of the diesel pile driving hammer of the present invention.
Figure 3:
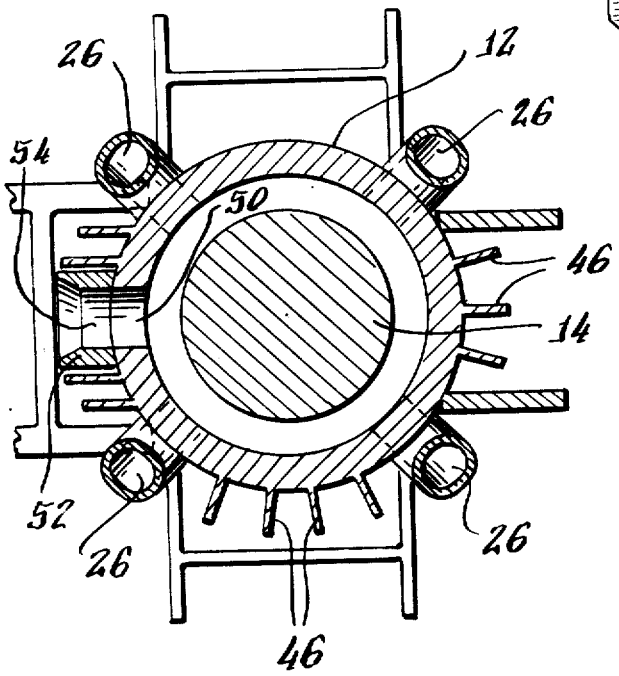
FIG. 3 is a cross-sectional view taken substantially along the plane indicated by line 3—3 of FIG. 2.

FIGS. 2 and 3 illustrate the actual construction of the pile driving hammer 10 of the present invention. Comparable elements to those indicated in FIGS. 1A–1E, inclusive, are indicated by the identical numerals. In FIGS. 2 and 3, however, the fuel pump and fuel pump cam as well as the hoist trip mechanism have been deleted; it being understood that the operation of the pile driving hammer 10 illustrated in FIGS. 2 and 3 is identical to that illustrated in FIGS. 1A–1E, inclusive, as far as fuel injection and initial starting operation of the hammer are concerned.

In addition to the elements discussed and described above, the pile driving hammer 10 of FIGS. 2 and 3 is provided with vertical cooling fins 46, which act as radiators, connected to the outer cylinder casing 12 to radiate heat away from the hammer. The pile driving hammer 10 of FIGS. 2 and 3 is adapted to be provided with interchangeable rams 14 and pistons 16 integral therewith. This enables the same outer cylinder 12 to be utilized with different weight rams so that economically, the impact energy delivered by the pile drive hammer may be varied, as required, to achieve fuel conservation, different driving forces as necessary, etc., utilizing basically the same equipment except for a heavier or lighter ram-piston combination. However, when utilizing rams 14 of different weight, the volume of swept air required for efficient combustion and the time of travel of the upward flight of the ram after impact and explosion will vary. The inlet ports of the impact diesel pile hammer 10 which are also the exhaust ports must thus provide a sufficient, non-restricted opening or openings to assure the introduction of the proper volume of swept air for combustion, and must also enable all of the exhaust gases of combustion to be expelled in the time it takes the ram to travel its upward flight. This time of travel may be on the order of less than 0.35 seconds, for example.

It has been empirically determined that when replacing lighter weight with heavier weight rams, such as when replacing a two thousand or twenty eight hundred pound ram with a thirty-three hundred pound ram, a sufficient, non-restricted opening to expel all of the gases of combustion during the return stroke of the ram-piston, while enabling the proper swept air volume to enter the combustion chamber of cylinder 12 can be achieved by providing a single larger diameter hole or orifice 50 in the outer casing or cylinder 12 as the air inlet-exhaust port for the heavier weight ram. The hole or orifice 50 is located between and above two of the inlet-exhaust ports 26 which are normally utilized for the lighter ram. During operation of the pile driving hammer 10 with the heavier ram, all of the ports 26 are closed or plugged with high strength pipe plugs 56.

The ram inlet-exhaust port 50 is in communication with an air intake pipe 52 having an opening or bore 54 therethrough in communication with the opening 50. When using the lighter ram, the opening 50 will remain open while the plugs in ports 26 are removed. The use of the auxiliary port 50 renders the pile driving hammer 10 flexible in that different, interchangeable weight rams may be used with a single outer casing or cylinder 12 and its attendant accessories. Since the single opening 50 is at a higher elevation than ports 26, a proper volume of air can be introduced through the sole opening 50 and compressed in the cylinder, as required, when the heavier ram is used, while enabling all of the exhaust gases to be expelled. Conversely, with a lighter ram, all of the ports 26 and 50 can be open as there will be no change in swept air volume.

I claim:

1. In a pile driving diesel-engine hammer adapted to be provided with interchangeable rams to drive a pile into a foundation comprising:

an outer cylindrical casing having a combustion chamber therein, at least two interchangeable rams of different weights, each having a piston at one end thereof to be slidably received in said casing above said combustion chamber, at least one pair of air intake-exhaust ports provided in the wall of said outer cylindrical casing and in communication with said combustion chamber, an anvil seated in the bottom of said outer cylindrical casing below said combustion chamber and said pair of air intake-exhaust ports, a pile driving cap connected to said anvil, and means on said outer cylindrical casing for introducing fuel into said combustion chamber for admixture with air received through said air intake-exhaust ports in response to movement of a ram within said casing, the improvement comprising:

means for plugging said intake-exhaust ports when the heaviest one of said rams is in said casing, and an auxiliary and alternate air intake-exhaust means including an opening circumferentially spaced from said pair of air intake-exhaust ports in the outer cylindrical casing and at a greater height above said anvil than said pair of air intake-exhaust ports for introducing air into said combustion chamber and for receiving the products of combustion expelled from said chamber when said plug means are inserted in said pair of air intake-exhaust ports and said hammer is in use with the heaviest one of said rams.

2. In the pile driving hammer of claim 1 wherein said auxiliary and alternate exhaust-intake opening is of a larger diameter than either of the pair of exhaust-intake ports.

3. The method of operating a pile driving diesel-engine hammer having an outer cylindrical casing adapted to slidably receive a ram and an anvil for driving a pile therein, said ram having a piston at one end thereof adapted to compress a fuel-air mixture introduced into said casing between said ram and anvil through at least a pair of air inlet-exhaust ports above said anvil so that said mixture will explode to impact said anvil, and raise said ram and piston said method comprising the steps of:

replacing the ram with a ram of heavier weight within said cylindrical casing to vary the impact energy delivered by said hammer while providing an auxiliary air intake-exhaust opening of larger diameter than said pair of air inlet-exhaust ports between said pair of air inlet-exhaust ports at a greater height above said anvil as said pair of air inlet-exhaust ports, and plugging said pair of inlet-exhaust ports.

* * * * *